United States Patent [19]

Stalder

[11] 4,249,286

[45] Feb. 10, 1981

[54] FIBER SLIVER OPENING ROLL FOR AN OPEN-END SPINNING DEVICE

[75] Inventor: Herbert Stalder, Kollbrunn, Switzerland

[73] Assignee: Rieter Machine Works Ltd, Winterthur, Switzerland

[21] Appl. No.: 4,737

[22] Filed: Jan. 18, 1979

[30] Foreign Application Priority Data

Feb. 1, 1978 [CH] Switzerland ..... 1093/78

[51] Int. Cl.[3] ..... D01G 15/14

[52] U.S. Cl. ..... 19/97; 19/112; 29/121.1; 57/58.91

[58] Field of Search ..... 19/97, 112; 29/121.1; 57/58.91, 58.93, 58.95

[56] References Cited

U.S. PATENT DOCUMENTS

| | | | |
|---|---|---|---|
| 3,737,951 | 6/1973 | Mackie | 19/97 |
| 4,005,513 | 2/1977 | Egerer | 19/97 X |
| 4,058,965 | 11/1977 | Shaw et al. | 19/112 |
| 4,122,656 | 10/1978 | Shaw | 19/112 X |
| 4,135,355 | 1/1979 | Stewart | 19/112 X |
| 4,169,348 | 10/1979 | Blackburn | 57/58.91 |

*Primary Examiner*—Louis Rimrodt

*Attorney, Agent, or Firm*—Werner W. Kleeman

[57] ABSTRACT

A fiber sliver opening roll of an open-end spinning device is equipped with needles, wherein the needle shaft of each needle is mounted in a bore. The surface of the opening roll is provided with outer, wide recesses which clear or leave free the needles at all sides. Below the bases of the recesses there are located the aforementioned bores which are smaller than the recesses. Between each needle and the side wall of the related recess there is left free a clearance or space. The depth of each recess is greater than the distance at the recess base between the outer surface of the needle and the inner wall of the recess, and which depth amounts to from 1 to 10 times the aforementioned distance. Owing to the provision of each such recess the related needle extends free on all sides between the roll surface and the bore in such a manner that there are prevented fiber jamming and fiber accumulations on the needles.

12 Claims, 6 Drawing Figures

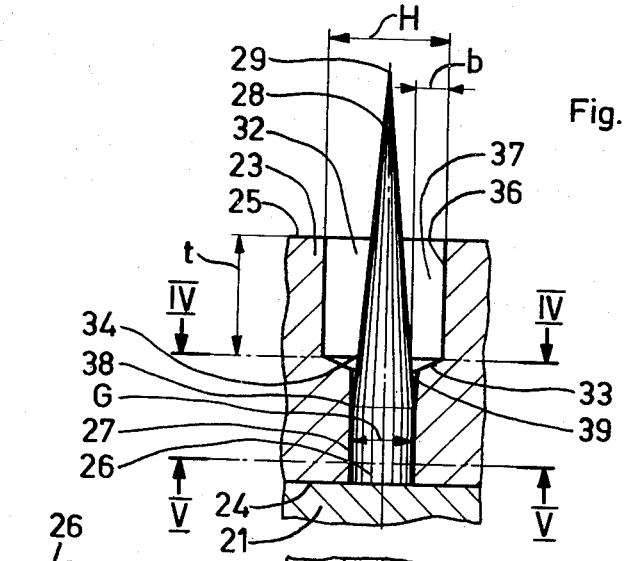
Fig. 3
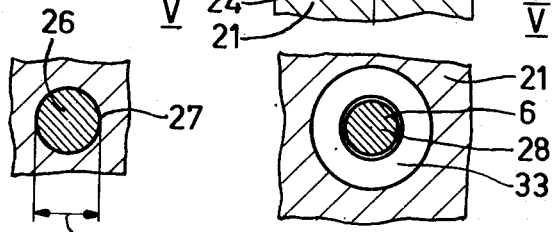
Fig. 4
Fig. 5
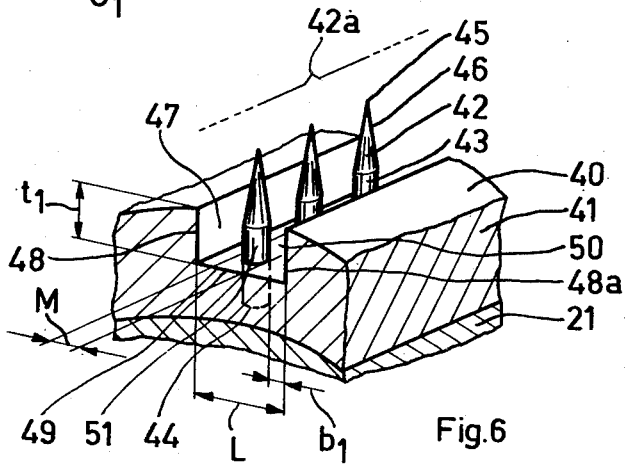
Fig. 6

FIBER SLIVER OPENING ROLL FOR AN OPEN-END SPINNING DEVICE

BACKGROUND OF THE INVENTION

The present invention relates to a new and improved construction of opening roll for an open-end spinning device for opening a fiber sliver with the aid of needles which are inserted by means of their needle shafts into bores provided in a cylindrical body, wherein the points of the needles protrude from such cylindrical body.

In prior art opening rolls of the above-mentioned type, for instance as disclosed in the German Patent Publication No. 2,529,336 and the corresponding U.S. Pat. No. 4,058,965, granted Nov. 22, 1977, it is difficult, during mounting of the needles in the very narrow bores receiving the needle base, to attain an exact central, i.e., coaxial position of each needle in its related narrow bore. Due to for instance imprecise insertion, needle bending during insertion or imprecise needle profiles or cross-sectional shapes, an annular gap is formed between the needle and the wall of the bore. This annular gap tapers off along the needle and, viewed in cross-section, is of essentially crescent configuration. In these gaps there are entrapped fibers. This results in undesirable fiber accumulations on the needles and thus on the roll surface. When this happens there is not only impaired the opening performance of the needles, that is to say their efficiency, due to increasing blockage by the accumulated fiber material, but there also result uncontrolled breaking loose of such fiber accumulations which causes uncontrolled and disorderly fiber feed to the fiber collecting surface of the open-end spinning device. This in turn produces an uneven yarn due to the disturbed fiber supply. If the transition point between the cylindrical needle shaft and the conical, pointed needle section is located below the roll surface, i.e., if the conical needle section also extends within the needle shaft bore, then there are intensified the aforementioned disturbances because already by virtue of the conicity of the needle there is formed a tapered, annular gap along the needle.

SUMMARY OF THE INVENTION

Therefore, with the foregoing in mind it is a primary object of the present invention to provide a new and improved construction of fiber sliver opening roll for an open-end spinning device which is not associated with the aforementioned drawbacks and limitations of the prior art constructions.

Another and more specific object of the present invention aims at providing a fiber sliver opening roll for an open-end spinning device having needles of the previously mentioned type, wherein there are eliminated the disadvantages of the state-of-the-art opening rolls, and wherein the roll surface is maintained free of undesirable fiber accumulations forming at the needles, and further, wherein there is facilitated insertion of the needles into their bores.

Now in order to implement these and still further objects of the invention, which will become more readily apparent as the description proceeds, the fiber sliver opening roll for an open-end spinning device or spinnning machine of the present invention is manifested by the features that there is provided an outer, wide recess, which clears the related needle at all sides. Each such recess has a side wall and a base at which merges the lower situated receiving bore in which there is fixedly seated the needle shaft of the associated needle.

With the fiber sliver opening roll of the invention, owing to the recess formed by the base, the needle extends freely at all sides between the roll surface and the bore in a manner such that even if, for instance, the needles are imprecisely inserted into the bores, if they are bent during insertion, or if their profile or cross-section is inaccurate, the individual needle remains free of jammed fibers, and thus, is maintained free of undesirable and disturbing fiber accumulations especially at the roll surface. A tapered gap formed between the needle and the bore during the insertion of the needle can be neglected in the opening roll constructed according to the invention, since this gap is located below the roll surface and is shielded by the recess from the roll surface and therefore is ineffective for clamping fibers. The opening roll according to the invention has been found to be advantageous if, for instance, the conical portion of the needle extends into the bore, because then an annular, tapering gap formed at that location due to the conical shape of the needle cannot be reached by the fibers owing to the provision of the recess. By selecting the cross-sectional area of the recess to be larger than the cross-sectional area of the bore there is advantageously maintained a clearance between the needle and the oppositely situated side wall of the recess, which side wall extends in the longitudinal direction. In such clearance any fibers penetrating therein are not clamped and such fibers can again be eliminated from such clearance, for instance by an air stream which acts, as is known, on the opening roll. The recess advantageously has a depth and a width at the base chosen such that there is insured for a free movement of the fibers, i.e., unclamped fibers, and the base of the recess is located far enough from the roll surface so that fibers penetrating into the clearance do not reach the base of the recess.

The needle shaft can be press-fitted into its related bore, or if inserted with radial play can be rigidly anchored by utilizing a suitable fixing or attachment medium, e.g., a synthetic resin as a bonding agent. The needles can be radially arranged in the opening roll or at an inclination, as viewed in the direction of rotation of such opening roll.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 3 illustrates in an enlarged fragmentary sectional view a detail of the opening roll according to FIG. 2;

FIG. 4 is a sectional view of part of the opening roll shown in FIG. 3, the section being taken substantially along the line IV—IV thereof;

FIG. 5 is a sectional view of part of the opening roll shown in FIG. 3, taken substantially along the line V—V thereof; and FIG. 6 illustrates in section a partially broken away, perspective and schematically shown further embodiment of a part of an opening roll according to FIGS. 1 and 2.

DETAILED DESCRIPTION OF THE PREFERRED EMBODIMENTS

Figure 1:
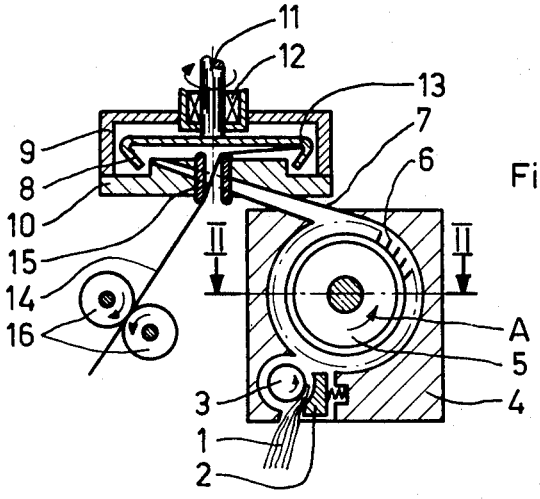
FIG. 1 is a schematic sectional view of an open-end spinning device or machine equipped with an opening roll constructed according to the invention.

Describing now the drawings, at an open-end spinning device or spinning machine a fiber sliver 1 is infed to an opening roll 5 by means of a feed roll 3 which cooperates with an elastically pretensioned pedal lever 2 or equivalent structure. This opening roll 5 is rotatably supported in a housIng 4 and driven in any suitable fashsion so as to rotate in the direction of the arrow A. Further, such opening roll 5, which defines a substantially cylindrical body, is equipped with needles 6 which, in the embodiment under consideration, are forwardly inclined, viewed in the direction of rotation A. These needles 6 serve to open the fiber sliver 1 into individual fibers. Leading from the opening roll 5, which supplies individualized fibers, is a fiber feed duct or channel 7 which guides a fiber and air stream to a spinning rotor 8 which is exposed to a negative pressure or vacuum as is well known in the open-end spinning art. This spinning rotor 8 is rotatably and drivably supported by means of a shaft 11 and a bearing 12 in a housing 9 equipped with a cover 10. The individual fibers are deposited upon a fiber collecting surface 13 of the spinning rotor 8, at which location they are spun into a yarn 14 which is removed by means of a pair of take-off rolls 16 via a take-off or removal duct 15 and subsequently wound onto a not particularly shown but conventional bobbin package.

Figure 2:
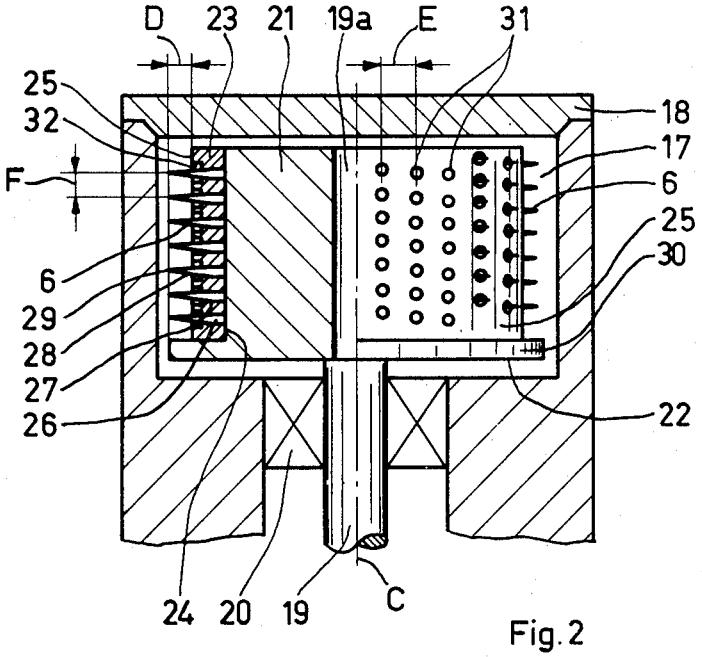
FIG. 2 is a sectional view of the opening roll shown in FIG. 1, taken substantially along the line II—II thereof.

As best seen by referring to FIG. 2, the opening roll is arranged in a hollow space or compartment 17 of the stationary housing 4 which is sealed by a cover 18 or equivalent structure. The opening roll 5 is rigidly mounted on a shaft 19 which, in turn, is rotatably supported for rotation about an axis C in a bearing 20. The opening roll 5 contains a cylindrical hub 21 which is rigidly mounted upon a reduced shaft portion 19*a*. This opening roll 5 further comprises an end or face wall 22 which extends radially from the hub 21 towards the outside. A substantially cylindrical, rigid ring 23, formed for instance of brass or aluminium, and having an inner circumferential surface 24 is coaxially arranged on the hub 21. The outer circumference of the cylindrical, rigid ring or ring member 23 forms a roll surface 25 of the opening roll 5. Needles 6 each having a substantially cylindrical needle shaft 26 are tightly fitted into individual bores 27 which penetrate through the ring 23 to the inner circumferential surface 24. Each of these needles 6 contains a conical portion 28 which protrudes past the roll surface 25 of the opening roll 5 and terminates in a needle point or tip 29. The end wall 22 contains a radial flange 30 which extends beyond the roll surface 25 by the radial distance D, and further, the needle points or tips 29 likewise protrude past the roll surface 25 by the same distance D. The needles 6 are arranged in rows 31 which extend essentially parallel to the lengthwise axis C of the opening roll 5 and are shown, by way of example, to be equally spaced along the circumference of the opening roll 5 with a gauge or distribution E. The distance F between needles in a row is smaller than the gauge E. However, it is to be specifically understood that other needle arrangements are possible, for instance an arrangement affording a uniform needle density over the entire roll surface.

Now as shown in FIGS. 3 to 5 in an enlarged view for one of the needles 6 a recess 32 is provided so as to be coaxially dispositioned with respect to the related smaller size needle receiving bore 27. Each such recess 32 has a diameter H which exceeds the diameter G of the bore 27, and further, possesses a depth t. Each such recess 32 has a base portion defined by a slightly inclined shoulder 33 which extends towards the needle 6 and merges with the needle shaft bore 27. As best seen by referring to FIG. 5, the needle shaft 26 has a diameter $G_1$ and is press-fitted into its bore 27 so as to be able to withstand the centrifugal forces which arise during operation of the fiber sliver opening roll. By means of the recess 32 which has a diameter H there is formed an annular or ring-shaped gap 37 which surrounds the related needle 6. The depth t of the recess 32 is larger than the distance b of the needle surface 34 from the bore wall or inner wall 36 of the recess 32 at the base formed by the shoulder 33. The diameter H is selected in accordance with the needle thickness, i.e., the diameter $G_1$ of the needle shaft 26 which is in the order of about 0.6 millimeters to 1.0 millimeters, preferably between about 0.6 millimeters to 0.8 millimeters. The diameter H is selected so as to be at least equal to 0.7 millimeters for a needle shaft diameter $G_1$ of about 0.6 millimeters. On the other hand the diameter H is chosen such that the distance b substantially exceeds the fiber thickness which is in the order ot about 0.002 millimeters to 0.05 millimeters, that is to say, the distance b is chosen to be larger than for instance 0.05 millimeters. In the case of cotton the fiber thickness is in the order of about 0.002 millimeters to 0.01 millimeter. The distance b is preferably chosen to be in the order of about 0.05 millimeters to 0.15 millimeters. The lowest limit of the depth t is in the order of 1 to 10 times the distance b. There is preferably chosen 5 times the distance b. The upper limit of the depth t is selected according to the length of the bore 27 required to insure stability of the needle shaft 26. The needle 6 is placed such that a transition point or location 38 between the needle shaft 26 and the conical portion 28 is located below the shoulder 33. A tapering, annular or ring-shaped gap 39 which is formed between the conical portion 28 and the needle shaft 27 cannot be reached by the fibers owing to the recess 32, and thus, cannot cause jamming of fibers. The annular or ring-shaped gap 37 insures that any fibers which penetrate into the same remain free and unclamped, and thus the needle 6 remains free of fiber accumulations. This is further enhanced by an increasing distance between the needle 6 and the bore wall or inner wall 36 in the direction of the roll surface 25.

As best seen by referring to FIG. 6, wherein the same or analogous elements have been designated with the same reference characters as employed in conjunction with FIGS. 1 and 2, here a ring or ring member 41 which forms a roll surface 40 is coaxially arranged upon the hub 21. This ring 41 is equipped with needles 42. Each of these needles 42 has a cylindrical shaft 43 which is mounted in a related bore 44 provided at the ring 41 and the conical portion or part 46 of each such needle extends into a point 45 and protrudes from the roll surface 40. A recess or channel 47 extends axially along a row of needles 42*a*. Such recess or channel 47 is in the form of a groove having a substantially rectangular cross-sectional configuration and possessing side walls 48 and 48*a*. Such channel-shaped recess 47 has a depth $t_1$ and a base 49 of a width L which is larger than the diameter M of the bores 44. Between each needle shaft 43 and the opposite side wall 48 or 48*a*, as the case may be, there is left free a clearance or space 50 of the depth $t_1$, this clearance 50 being larger than the distance $b_1$ of the needle surface 51 from the side wall 48 or 48*a*, respectively, at the region of the base or shoulder 49, and the width of which again can be chosen to be in the range of 1 to 10 times the distance $b_1$. The side walls walls 48 and 48*a* extend in the lengthwise direction of the needles 42.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A fiber sliver opening roll for an open-end spinning device, comprising:

means providing a substantially cylindrical body for receiving needles, said body having a radially outwardly facing surface;

a plurality of needles each having a needle point and a needle shaft;

means for mounting each of the needles at the cylindrical body such that the needle points of the needles protrude from said surface of the cylindrical body;

said mounting means comprising for each needle:

an outer, wide recess in said surface of a size sufficient to clear the related needle at all sides;

said recess being provided with a side wall and a base;

a bore smaller than said recess located below said recess; and said bore securely fixing the needle shaft of the needle.

2. The opening roll as defined in claim 1, wherein: said base forms a shoulder extending in the direction of the needle.

3. The opening roll as defined in claim 2, wherein: said shoulder is slightly inclined towards the needle.

4. The opening roll as defined in claim 1, wherein:

said recess has a depth which corresponds to 1 to 10 times the distance between an outer surface of the needle and the side wall of the recess at the region of said base.

5. The opening roll as defined in claim 4, wherein:

the depth of the recess amounts to about 5 times said distance between the needle surface and the side wall of the recess at the region of the base.

6. The opening roll as defined in claim 4, wherein:

said distance between the needle surface and the side wall of the recess at the region of the base amounts to approximately 0.05 millimeters to 0.15 millimeters; and the diameter of the needle shaft being in the order of about 0.6 millimeters to 0.8 millimeters.

7. The opening roll as defined in claim 4, wherein:

the distance between the needle surface and the side wall of the recess at the region of the base exceeds a fiber thickness of about 0.002 millimeters to 0.05 millimeters.

8. The opening roll as defined in claim 1, wherein:

each needle has a substantially cylindrical needle shaft and a conical part terminating at said needle point;

a transition location of each needle between the cylindrical needle shaft and the conical part being located below the base and within the bore receiving the needle shaft.

9. The opening roll as defined in claim 1, wherein:

each of the needles are press-fitted in their related bore.

10. The opening roll as defined in claim 1, wherein:

said mounting means further include a ring provided with a respective bore and recess for receiving each needle;

said needles being fitted into said ring and through the bores and recesses thereof; and said cylindrical body including a hub portion at which there is press-fitted said ring.

11. The opening roll as defined in claim 1, wherein:

said recess defines a separate recess for each needle which is arranged coaxially with respect to its related needle and forms a substantially annular gap around such needle.

12. The opening roll as defined in claim 1, wherein:

said recess comprises a groove extending along a row of needles;

said groove having a base at which there are provided the bores for the needle row.

* * * * *